United States Patent [19]

Bayn

[11] 4,412,397

[45] Nov. 1, 1983

[54] FIREARM SAFETY APPARATUS AND METHOD OF USING SAME

[76] Inventor: William H. Bayn, 5095 Pettis, Belmont, Mich. 49306

[21] Appl. No.: 359,683

[22] Filed: Mar. 19, 1982

[51] Int. Cl.[3] ..... F41C 27/00

[52] U.S. Cl. ..... 42/1 LP

[58] Field of Search ..... 42/1 LP, 1 N, 1 Y

[56] References Cited

U.S. PATENT DOCUMENTS

| | | | |
|---|---|---|---|
| 835,349 | 11/1906 | Deming . | |
| 1,461,257 | 7/1923 | Thompson . | |
| 2,350,717 | 6/1944 | Blair | 42/1 |
| 2,898,903 | 8/1959 | Hovermale | 124/2 |
| 3,022,598 | 2/1962 | Wikstrom | 42/66 |
| 3,137,957 | 6/1964 | Ingalls | 42/1 |
| 3,354,569 | 11/1967 | Kassabian | 42/1 |
| 3,495,581 | 2/1970 | Schafler | 124/18 |
| 3,634,963 | 1/1972 | Hermann | 42/1 N |
| 3,720,014 | 3/1973 | Goodrich | 42/1 N |
| 4,001,919 | 1/1977 | Moberg et al. | 24/16 PB |
| 4,058,923 | 11/1977 | Smith | 42/1 LP |
| 4,122,620 | 10/1978 | Alexander | 42/1 LP |

FOREIGN PATENT DOCUMENTS

| | | |
|---|---|---|
| 378767 | 12/1922 | Fed. Rep. of Germany . |
| 362 | of 1862 | United Kingdom . |
| 23895 | of 1915 | United Kingdom . |

*Primary Examiner*—Charles T. Jordan

*Attorney, Agent, or Firm*—Price, Heneveld, Huizenga & Cooper

[57] ABSTRACT

The specification discloses a firearm safety kit for disabling a firearm. The kit includes a frangible strap to be secured about the firearm to prevent a movable member, such as the hammer, from moving as required to fire the firearm. Application of predetermined pressure breaks the strap and enables the firearm to be fired. In another aspect for bolt-action firearms, the safety kit includes an insert to be positioned between the bolt and chamber and held in position by the frangible strap. A firearm with the safety apparatus installed thereon and a method of using the apparatus are also disclosed.

54 Claims, 15 Drawing Figures

FIREARM SAFETY APPARATUS AND METHOD OF USING SAME

BACKGROUND OF THE INVENTION

The present invention relates to firearms, and more particularly to a safety apparatus for rendering firearms temporarily inoperative.

As one facet of proper firearm practice, all firearms should be rendered inoperative during transportation and storage. A disabled gun cannot accidentally discharge if a cartridge is inadvertently left in the firearm chamber. Second, disabling a firearm reduces the possibility that an unsupervised child will be able to discharge the firearm. Third, people in the vicinity of the firearm feel more comfortable knowing that the firearm is inoperative.

Although many safety devices have been developed for disabling firearms, these devices are not without their disadvantages. One such device includes a hinged, metal clamp, which may be locked around the stock of a rifle to hold the hammer against the chamber. An example of this device is shown in U.S. Pat. No. 835,349, entitled SAFETY LOCK FOR FIREARMS, and issued Nov. 6, 1906, to Deming. However, this device must be locked about the rifle stock and cannot be readily or rapidly removed in an emergency situation. Removal problems are further complicated if the lock key is lost or not available. Second, because the device is a rigid, metal member, a unique device having a particular size and shape is required for each model of firearm on which it is to be installed. Third, the metal device is relatively expensive.

Another type of safety device includes an elongated member which may be secured such that it extends through the barrel of the firearm. These devices further include a plug on a one end of the elongated member anchored in the chamber, and a locking device releasably secured to the opposite end of the elongated member at the forward end of the barrel. Examples of this type of disabling apparatus are shown in U.S. Pat. No. 3,720,014, entitled REMOVABLE SAFETY DEVICE FOR DISABLING FIREARMS, issued Mar. 13, 1973, to Goodrich; U.S. Pat. No. 3,137,957, entitled SAFETY DEVICE FOR FIREARMS, issued June 23, 1964, to Ingalls; and U.S. Pat. No. 3,022,598, entitled SAFETY DEVICE FOR A REVOLVER, issued Feb. 27, 1962, to Wikstrom. However, these disabling apparatuses cannot be readily and rapidly removed from the firearm in an emergency situation. Also, these devices are relatively complicated and consequently expensive.

Yet another firearm disabling device includes a locking mechanism which may be positioned in the receiver of a firearm and locked therein to prevent the bolt from sliding forward into its operative position proximate the chamber. Such a device is illustrated in U.S. Pat. No. 3,634,963, entitled FIREARM LOCK, issued Jan. 18, 1972, to Hermann. However, as with the previously described disabling devices, this locking mechanism may not be readily removed from the firearm, particularly if the lock key is lost or not readily available. Second, the device is complicated, and accordingly expensive. Third, devices of different sizes are required for firearms having different size receivers.

SUMMARY OF THE INVENTION

The aforementioned problems are solved by the present invention. Essentially, a gun safety apparatus is provided which positively renders the firearm inoperative, yet can be rapidly removed when necessary. The apparatus includes a frangible strap and means for securing the frangible strap about the firearm to prevent an element of the firearm from moving to a position necessary to fire the device. The safety apparatus may be installed on the firearm to render the firearm inoperative, and subsequently rapidly removed by fracturing the strap and removing the strap from the firearm.

In another aspect of the invention, a safety apparatus is provided for firearms having a chamber and a bolt movable relative to the chamber. This apparatus includes an insert to be positioned between the bolt and the chamber, a fracturable strap, and means for securing the fracturable strap about the firearm to retain the insert in position. The firearm is disabled because the insert prevents the bolt from traveling to a position adjacent the chamber necessary to fire the gun. However, the apparatus can be rapidly removed by fracturing the strap and removing the strap and insert from the firearm.

The gun safety apparatus of the present invention is an inexpensive device capable of positively and visibly disabling a firearm to prevent accidental discharge and injury. However, the disabled firearm can be rapidly readied for use simply by fracturing the strap and removing the strap from the firearm. The strap can be secured about virtually any firearm, eliminating the need for different models of safeties for different models of firearms.

These and other objects, advantages, and features of the invention will be more fully understood and appreciated by reference to the written specification and appended drawings.

DESCRIPTION OF THE PREFERRED EMBODIMENTS

Figure 1:
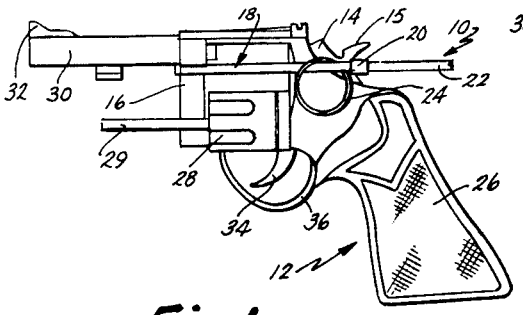
FIG. 1 is a side view of a revolver with its cartridge cylinder in open or unloading position and having the safety apparatus of the present invention installed thereon.

A gun safety apparatus or device in accordance with a preferred embodiment of the invention is illustrated in the drawings and generally designated 10. In FIG. 1, safety apparatus 10 is shown installed on revolver 12, which includes hammer 14 and frame 16. Device 10 includes a frangible strap 18 having an integral locking head 20 through which free end, or tail, 22 of strap 18 may be inserted to secure the strap about the revolver. In FIG. 1 strap 18 is secured about hammer 14 and frame 16 of revolver 12 to prevent hammer 14 from being drawn to fire the revolver. Although strap 18 is preferably cut to remove device 10 from revolver 12, pull ring 24 is secured on strap 18 to facilitate fracturing the strap if a cutting implement is not handy or if device 10 is to be rapidly removed.

Revolver 12 is well known to those having ordinary skill in the art. Suffice it to say that revolver 12 also includes stock or handle 26, and barrel 30 having sight 32 mounted thereon. Cylinder 28 is rotatably carried within frame 16 on cylinder shaft 29 and defines a plurality of chambers (not visible), each of which is selectively alignable with barrel 30. Additionally, revolver 12 includes a spur 15 on hammer 14, and trigger 34 which, when drawn, first draws hammer 14 away from frame 16 and then releases the hammer to strike a cartridge (not shown) within cylinder 28. Trigger guard 36 extends about trigger 34 from frame 16 to protect the trigger against accidental impact.

Figure 15:
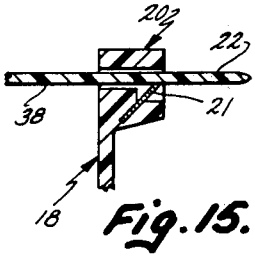
FIG. 15 is a sectional view taken along plane XV—XV in FIG. 3.

Turning more specifically to the construction of safety device 10 (particularly FIG. 3), it is seen that the device includes a frangible strap 18 and a pull ring 24 through which the strap extends when secured about a firearm. In the preferred embodiment, strap 18 is a cable tie of the type used to bundle wires. Exemplary of the cable ties which may be used with the present invention are those sold under the registered trademark "TY-RAP" by Thomas and Betts Corporation of Raritan, N.J., and those sold under the registered trademark "PAN-TY" by Panduit Corp. of Tinley Park, Ill. Strap 18 includes an integral locking head 20 and a free end, or tail, 22. Locking head 20 (see also FIG. 15) includes a one-way locking mechanism, such as metal spring 21, so that when tail 22 is inserted through the head, the tail cannot be subsequently withdrawn. Strap 18 includes serrations 38 along one side thereof to improve the engagement of spring 21 with tail 22 passing therethrough. Although straps which include a locking head that only releasably secures tail 22 are available, such straps are not preferred because these straps can be relatively easily removed from the firearm. In the preferred embodiment, strap 18 is 14 inches long, enabling the strap to be installed on virtually every known firearm. Of course, strap 18 may have a shorter length for particular applications, for example, relatively small revolvers.

Pull ring 24 is a rigid circular member having a diameter of approximately 1 to 2 inches. Consequently, ring 24 is loosely positioned on strap 18, such that the ring can be positioned at any point along the length of the strap to facilitate installment of device 10 on a variety of models of firearms. In the preferred embodiment, ring 24 is a split steel ring, typically sold and used as a key ring. Ring 24 is dimensioned so that one's finger may be inserted into ring 24 to grasp and pull the ring, fracturing strap 18. Alternatively, pull ring 24 can be eliminated, in which case strap 18 is fractured by grasping and pulling the strap itself or by cutting with a suitable cutting instrument.

Safety device 10 is preferably installed on revolver 12 as illustrated in FIG. 1. Revolver 12 is first opened by shifting cylinder 28 out of frame 16 and emptying all of the cylinder chambers. Strap 18 is then inserted through pull ring 24 and wrapped about revolver 12, and more particularly around frame 16 under barrel 30 and around hammer 14 under hammer spur 15. Of course, strap 18, instead of being secured about frame 16, may be secured about any portion of revolver 12 generally opposite hammer 14, such as trigger guard 36. Tail 22 is then inserted through locking head 20 and strap 18 is drawn tightly about revolver 12 such that hammer 14 is held securely against the internal safety blocks (not shown) within revolver 12. When closed around the revolver in this fashion, strap 18 has a length sufficiently short to prevent it from being passed over portions of the gun adjacent its secured position, thus preventing removal except by breaking or cutting. Consequently, hammer 14 is prevented from being withdrawn rearwardly as is necessary to fire the revolver. Additionally, cylinder 28 is prevented from returning to its firing position within housing 16 because strap 18 extends across the cylinder opening in frame 16. When pistol 12 is to be fired, strap 18 is preferably severed using a cutting implement, such as fingernail clippers or scissors to prevent damage to any moving parts of the gun. However, if device 10 is to be rapidly removed, or if a cutting implement is not readily available, strap 18 can be fractured by grasping either pull ring 24 or strap 18 itself and pulling outwardly with sufficient force to break the strap. Strap 18 will fracture at a random point along its length, possibly at locking head 20. Although strap 18 may be grasped proximate housing 16 by inserting one's finger around the strap, it is preferable to grasp more accessible pull ring 24 which facilitates fracturing the strap.

Strap 18 is preferably fabricated of a nylon, has a rectangular cross section of approximately 0.095 inches by 0.040 inches, and has a tensile break strength of approximately 18 pounds. When such a strap is used, the strap can be broken with a good, hard, forceful pull using split ring 24. Device 10 cannot then be removed accidentally or inadvertently or by small children. Further, the force required to break strap 18 causes some discomfort to one's finger, so that any grogginess of the gun user is cleared when device 10 is removed. Of course, strap 18 may be fabricated of other materials having different tensile break strengths; however, if the break strength approaches 40 pounds, the strap must be cut to be removed from the revolver. Strap 18 may be fabricated from a polypropelene material; however, polypropelen weakens and partially breaks with each pull on the strap such that a child might break the strap with prolonged tampering.

Figure 2:
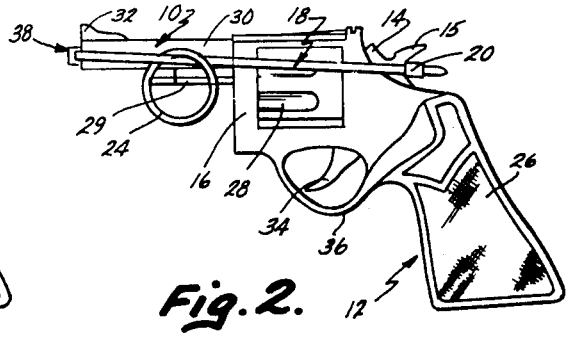
FIG. 2 is a side view of a revolver with its cartridge cylinder closed and having the safety apparatus installed thereon and including a barrel insert.
Figure 3:
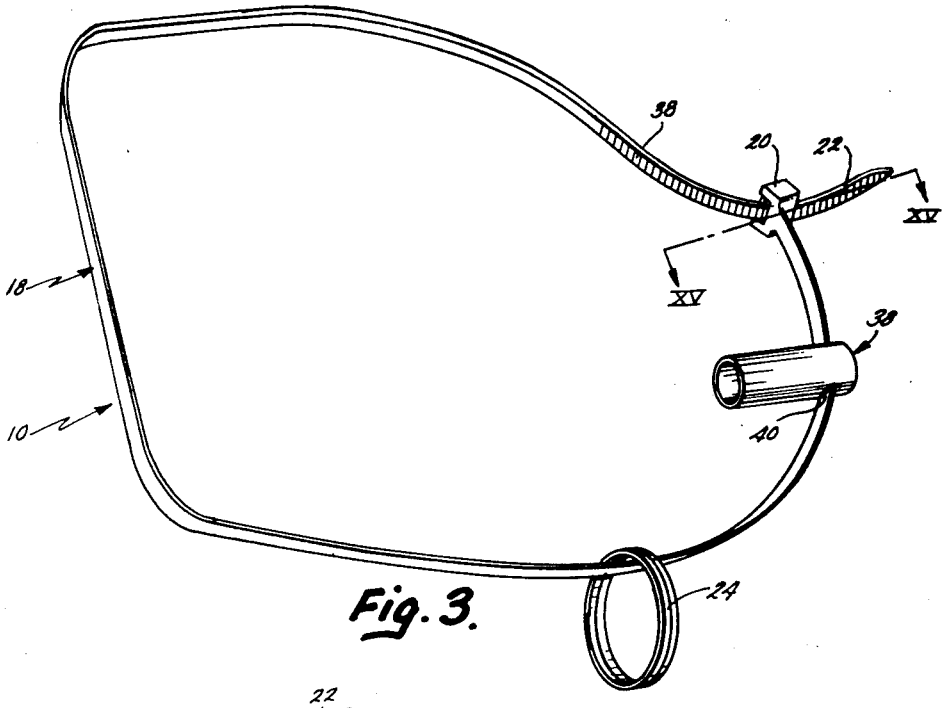
FIG. 3 is a perspective view of the safety apparatus including the barrel insert.

FIG. 2 illustrates an alternative securement of device 10 to revolver 12. In this embodiment, a barrel insert 38 is included and positioned within the forward end of barrel 30. As seen in FIG. 3, insert 38 is a generally cylindrical member having an outer diameter smaller than the bore of barrel 30. Additionally, insert 38 defines a transverse aperture or slot 40 through which strap 18 may pass. Device 10 is installed by inserting strap 18 through aperture 40 in insert 38 and then positioning the insert within barrel 30. Tail 22 is then inserted into locking head 20 and the strap is drawn snugly about hammer 14, more particularly under hammer spur 15. Preferably, pull ring 24 is positioned on strap 18 to facilitate fracturing the strap. Insert 38 thus effectively prevents undesired removal of the strap from the forward end of the gun and yet positions the strap in direct opposition to the hammer for maximum strength and pressure.

As seen in comparing FIGS. 1 and 2, safety device 10 may be installed on revolver 12 with cylinder 28 in either its operative or inoperative positions. If cylinder 28 is in an inoperative position outside of frame 16, strap 18 may be easily grasped with a finger in the region of frame 16. On the other hand, if cylinder 28 is in its operative position as indicated in FIG. 2, the disabled revolver is more compact and susceptible to storage.

Figure 4:
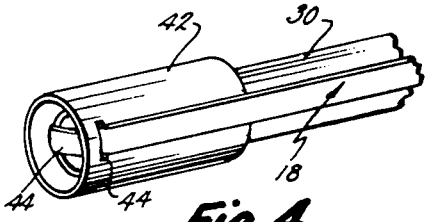
FIG. 4 is a fragmentary, perspective view of a revolver barrel having the gun safety apparatus installed thereon and including a barrel cap.

Another modification for mounting device 10 on a revolver is shown in FIG. 4. In this alternative, strap 18 is positioned over the end of barrel 30; however, it is held in position by barrel cap 42. Cap 42 is a generally cylindrical tubular member having an internal diameter sufficiently large so that the cap may be positioned over the end of barrel 30 including sight 32. Slots or apertures 44 extend transversely through cap 42 to receive strap 18. Device 10 is installed by inserting strap 18 through apertures 44 in cap 42, sliding cap 42 over barrel 30, and securing strap 18 around the revolver hammer to disable the gun.

Figure 5:
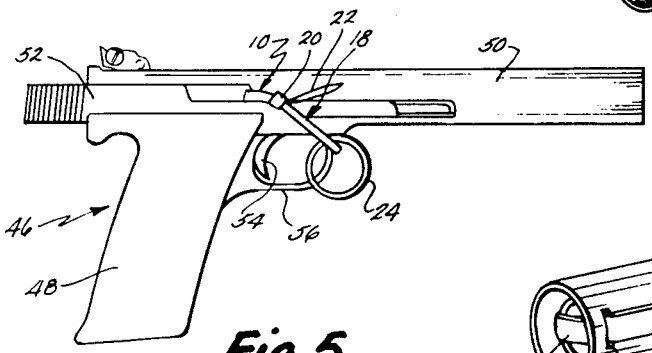
FIG. 5 is a side view of the gun safety apparatus installed on a semi-automatic pistol.

FIG. 5 illustrates the disablement of a semi-automatic pistol 46 having stock 48, barrel 50, slide 52, trigger 54, and trigger guard 56. Device 10 is installed on pistol 46 by drawing slide 52 rearwardly and inserting strap 18 between slide 52 and barrel 50. Ring 24 is then positioned on strap 18 and the strap is secured around trigger guard 56 adjacent the area where it joins barrel 50 as described above. Consequently, slide 52 may not move to its fully forward position necessary to position and discharge a cartridge into the pistol chamber (not visible).

Figure 6:
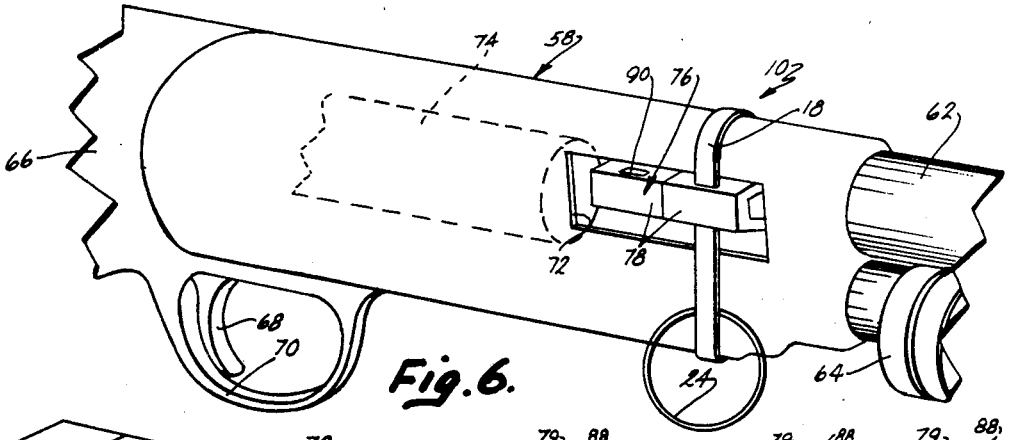
FIG. 6 is a fragmentary, perspective view of a rifle having the gun safety apparatus installed thereon and including a receiver insert.
Figure 7:
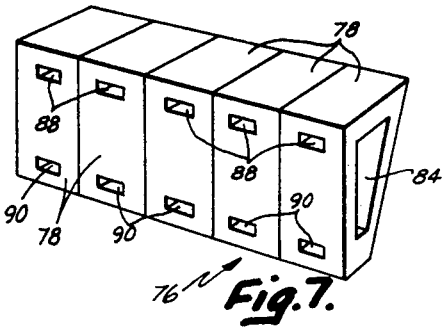
FIG. 7 is a perspective view of the insert assembly shown in FIG. 6.

FIG. 6 shows device 10 mounted on a rifle 58 including receiver 60, chamber 62 extending generally forwardly therefrom, and forearm 64 positioned immediately below chamber 62. Receiver 60 further defines ejection port 72. Bolt 74 is shiftably mounted for movement with respect to chamber 62. Stock 66 extends rearwardly from receiver 60. Rifle 58 further includes trigger 68 extending below receiver 60 and positioned when trigger guard 70. Rifle 58 is disabled by positioning insert assembly 76 within receiver 60 through ejection port 72 and between bolt 74 and chamber 62, and securing strap 18 transversely about receiver 60 to retain insert assembly 76 in position. Ring 24 is preferably installed on strap 18 to facilitate rapid and necessary strap fracture.

Figure 8:
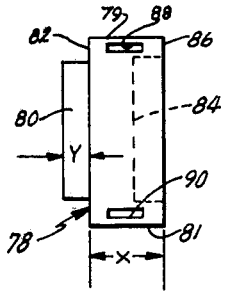
FIG. 8 is a front view of one of the insert segments shown in FIG. 7.
Figure 9:
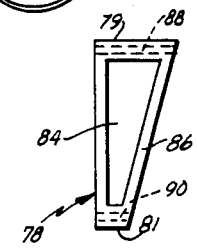
FIG. 9 is a right side view of the insert shown in FIG. 8.
Figure 10:
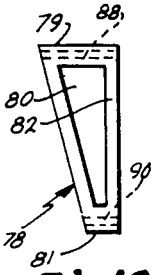
FIG. 10 is a left side view of the insert shown in FIG. 8.

FIGS. 7, 8, 9, and 10 illustrate insert assembly 76, which comprises a plurality of interconnected insert pieces 78. As seen in FIGS. 8, 9, and 10, each insert piece 78 is generally triangular in cross section, tapering from wide end 79 to narrow end 81. Triangular plug, or projection, 80 extends from side 82, and triangular socket 84 is defined by opposite side 86. The shapes of plug 80 and socket 84 are dimensioned so that socket 84 on one piece 78 will closely receive plug 80 from any other piece 78. Consequently, pieces 78 may be press-fitted together to form an assembly 76 of varying or desired width. In the preferred embodiment, width X of each piece 78 is approximately ½ inch, and width Y of each plug 80 is approximately ¼ inch. Consequently, by selectively push fitting pieces 78 together and selectively removing free plug 80 of the last piece, an assembly 76 can be constructed having a width from anywhere between ½ inch to 2¾ inches in ¼-inch increments.

Each piece 78 defines slots, or apertures, 88 and 90 in wide and narrow ends 79 and 81, respectively. Each aperture 88 and 90 is dimensioned to receive strap 18. Assembly 76 is constructed of a sufficient number of pieces 78 so that the assembly is as wide as possible and yet may still fit within ejection port 72. The insert assembly 76 shown in FIG. 6 comprises two such pieces 78 having a width of 1¼ inches. Strap 18 should be inserted through the most central or one of the two central pieces 78 of assembly 76 to prevent the installed assembly from tilting out of receiver 60. Large ends 79 are preferably inserted into the receiver 60 first; however, if the receiver will not accommodate the large ends, narrow ends 81 must be first inserted.

Figure 12:
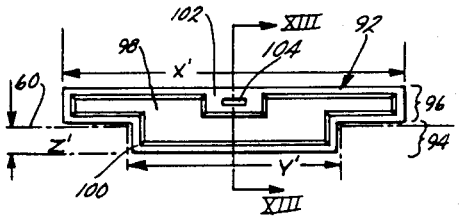
FIG. 12 is an alternative embodiment of the receiver insert.
Figure 13:
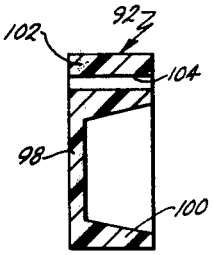
FIG. 13 is a sectional view taken along plane XIII—XIII in FIG. 12.

An alternative insert 92 is shown in FIGS. 12 and 13. Insert 92 is fabricated from plastic and is generally T-shaped, including leg portion 94 integrally joined to a cross-member portion 96. Insert 92 further includes a generally planar body portion 98 encircled by beveled ridge 100 which strengthens the body portion. Aperture block 102 integrally extends from cross-member portion 96 and defines securing aperture 104 dimensioned to receive strap 18. When adapter 92 is used in place of insert assembly 76, leg portion 94 is inserted into receiver 60 through ejection port 72 to separate bolt 74 from chamber 62. Cross-member portion 96 engages the outer portion of receiver 60 (shown in phantom) to maintain the insert in position. Strap 18 is inserted through aperture 104 and secured about receiver 60 to maintain the insert within receiver 60.

Alternative insert 92 is manufactured in three sizes wherein top length X', bottom width Y', and bottom length Z' are as follows:

| | Top Length X' | Bottom Width Y' | Bottom Length Z' |
|---|---|---|---|
| Size A | 2⅜" | ⅝" | ¾" |
| Size B | 3" | 1½" | 1" |
| Size C | 3½" | 2¼" | 1¼" |

One of these three sizes will accommodate virtually every commercially available firearm.

Figure 11:
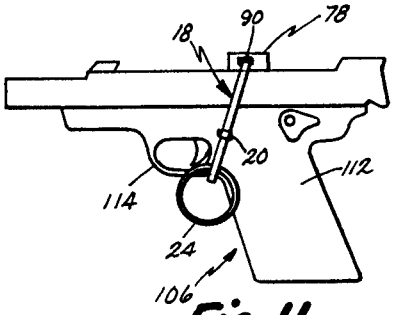
FIG. 11 is an elevational view of the gun safety apparatus installed on a pistol having a receiver and including a receiver insert.

Finally, FIG. 11 shows an insert piece 78 secured within the receiver (not visible) of a pistol 106, having stock 112 and trigger guard 114. The narrow end of insert 78 is positioned within the pistol receiver by drawing the bolt rearwardly and then positioning the insert between the bolt and the chamber. Strap 18 is then inserted through aperture 90 and secured about trigger guard 114 adjacent the area at which it joins stock 112 to maintain insert 78 within the pistol. Optionally, pull ring 24 may be included on strap 18 to facilitate fracturing the frangible strap.

Figure 14:
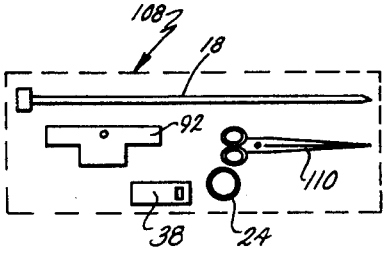
FIG. 14 is a plan view of a firearm safety kit containing elements of the present invention.

FIG. 14 illustrates a kit containing the necessary elements to install device 10 on virtually any firearm. Kit 108 includes strap 18, ring 24, barrel insert 38, receiver insert 92, and scissors 110. Alternately, a series of insert pieces 78 may be included. Because each of straps 18 is suitable for only a single use, being discarded after removal from the firearm, a plurality of straps 18 may be included in kit 108. Of course, any of ring 24, barrel insert 38, receiver insert 92 or insert pieces 78, and scissors 110 may be deleted from kit 108 depending upon the particular firearm for which the kit is designed. For example, if kit 108 were specifically for a revolver, the kit might include only 1) strap 18 and pull ring 24 or 2) strap 18 and scissors 110. On the other hand, if kit 108 is designed for a bolt action firearm, kit 108 might not include either or both of pull ring 24 and scissors 110.

Although not illustrated, device 10 can also be used to disable a shotgun by wrapping strap 18 around the broken (i.e., pivoted open for loading or unloading) gun so that the gun cannot be closed. Additionally, a firearm having a receiver open on both sides can be disabled by drawing the bolt rearwardly and securing a strap around the firearm and through the entire receiver.

It should be understood that the above description is intended to be that of preferred embodiments of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are described as follows:

1. A temporarily disabled firearm comprising:

a firearm having a chamber and a bolt movable relative to said chamber into and out of a ready-fire position adjacent said chamber;

an insert positioned between said bolt and said chamber for preventing said bolt from moving into said ready-fire position;

a fracturable strap; and means for securing said fracturable strap about said firearm to maintain said insert between said bolt and said chamber, whereby said firearm can be rendered operative by fracturing said strap and removing said strap and said insert from said firearm.

2. A firearm as defined in claim 1 wherein the tensile break strength of said fracturable strap is less than forty pounds.

3. A firearm as defined in claim 2 wherein the tensile break strength of said fracturable strap is approximately eighteen pounds.

4. A firearm as defined in claim 1 wherein said firearm further comprises grasping means secured to said strap for facilitating fracture of said strap.

5. A firearm as defined in claim 4 wherein said grasping means comprises a ring member through which said strap extends, said ring member dimensioned to receive a finger.

6. A firearm as defined in claim 1 wherein said insert comprises means for receiving said strap to more positively maintain said insert in position.

7. A firearm as defined in claim 1 wherein said firearm further comprises a receiver in which said bolt is slidably carried, said receiver having an outer portion, and wherein said insert is T-shaped having a leg extending into said receiver between said bolt and said chamber, said insert having a cross piece engaging said outer portion of said receiver.

8. A firearm as defined in claim 1 wherein said insert comprises a plurality of interconnected insert members.

9. A firearm as defined in claim 8 wherein each of said insert members includes means for press-fitting said insert members together.

10. A firearm safety device for rendering a firearm positively but temporarily inoperative, the firearm having a first element normally movable to a ready-fire position, the device comprising:

a fracturable strap; and means for securing said fracturable strap about the firearm to prevent the first element from moving to the ready-fire position, whereby the firearm is rendered operative by fracturing said strap and removing said strap from the firearm.

11. A firearm safety device as defined in claim 10 wherein said strap has first and second ends and wherein said securing means comprises means secured to said strap first end for lockingly receiving said strap second end.

12. A firearm safety device as defined in claim 10 wherein said strap comprises a cable tie and wherein said securing means comprises the locking head of said cable tie.

13. A firearm safety device as defined in claim 10 wherein the tensile break strength of said fracturable strap is less than forty pounds.

14. A firearm safety device as defined in claim 13 wherein the tensile break strength is approximately eighteen pounds.

15. A firearm safety device as defined in claim 10 further comprising grasping means coupled to said fracturable strap for fracturing said strap.

16. A firearm safety device as defined in claim 15 wherein said grasping means comprises a ring through which said strap extends, said ring being dimensioned to receive a finger.

17. A firearm safety device as defined in claim 10 wherein the first element comprises a hammer, the firearm also having a portion generally opposite the hammer; and wherein said strap is secured about the hammer and the portion of the firearm opposing the hammer.

18. A firearm safety device as defined in claim 17 wherein the firearm comprises a trigger guard and wherein the opposite portion comprises the trigger guard.

19. A firearm safety device for a firearm having an element normally movable to a ready-fire position, said device comprising:

a frangible strap;

means for securing said frangible strap about the firearm to prevent the element from moving to the ready-fire position; and grasping means loosely coupled to said frangible strap for facilitating fracture of said strap, said grasping means being slidable along said strap to facilitate installation of said device on the firearm.

20. A firearm safety device for a revolver having a barrel and a hammer, said device comprising:

a frangible strap;

means for positioning said strap on the forward end of the barrel;

means for securing said frangible strap about the hammer and the forward end of the barrel to prevent the hammer from being drawn; and grasping means coupled to said frangible strap for facilitating fracture of said strap, whereby said device can be rapidly removed from the firearm.

21. A firearm safety device as defined in claim 20 wherein said positioning means comprises a barrel insert positionable with the barrel and defining an aperture through which said strap passes.

22. A firearm safety device as defined in claim 20 wherein said positioning means comprises a barrel cap positionable over the forward end of the barrel and defining an aperture through which said strap passes.

23. A firearm safety kit for a firearm having a chamber and a bolt movable with respect to the chamber comprising:

an insert for positioning between the bolt and the chamber to render the firearm inoperative;

a frangible strap; and means for securing said frangible strap about the firearm for retaining said insert between the bolt and the chamber.

24. A firearm safety kit as defined in claim 23 wherein the tensile break strength of said frangible strap is less than forty pounds.

25. A firearm safety kit as defined in claim 24 wherein the tensile break strength of said frangible strap is approximately eighteen pounds.

26. A firearm safety kit as defined in claim 23 further comprising a grasping means to be coupled to said strap when said strap is secured to the firearm for facilitating breaking said strap.

27. A firearm safety kit as defined in claim 26 wherein said grasping means comprises a ring member.

28. A firearm safety kit as defined in claim 23 wherein said insert comprises means for receiving said strap.

29. A firearm safety kit as defined in claim 23 wherein the firearm is of the type having a receiver in which the bolt is slidably carried, the receiver having an outer portion; and wherein said insert is T-shaped having a leg for positioning in the receiver between the bolt and the chamber, said insert having a cross piece for engaging the outer portion of the receiver.

30. A firearm safety kit as described in claim 23 wherein said insert comprises a plurality of interconnected insert members.

31. A firearm safety kit as described in claim 30 wherein each of said insert members includes means for press-fitting said insert members together.

32. A firearm safety kit for a firearm having a movable member, the firearm being capable of firing only after the member has been moved to a certain position, said safety kit comprising:

a frangible strap;

means for securing said frangible strap about the firearm and preventing the member from moving to the certain position; and means for severing said frangible strap after said strap has been secured about the firearm, whereby said strap can be removed from the firearm so that the firearm can be fired.

33. A firearm safety kit as described in claim 32 wherein said strap has first and second ends and wherein said securing means comprises means secured to said strap first end for lockingly receiving said strap second end.

34. A firearm safety kit as defined in claim 32 wherein said strap comprises a cable tie and wherein said securing means comprises the locking head of said cable tie.

35. A firearm safety kit as defined in claim 32 wherein the tensile break strength of said frangible strap is less than forty pounds.

36. A firearm safety kit as defined in claim 35 wherein the tensile break strength is approximately eighteen pounds.

37. A firearm safety kit as defined in claim 32 further comprising grasping means to be coupled to said strap when said strap is secured about the firearm for facilitating breaking said strap.

38. A firearm safety kit as defined in claim 37 wherein said grasping means comprises a ring through which said strap extends, said ring being dimensioned to receive a finger.

39. A firearm safety kit as defined in claim 32 wherein the firearm further includes a barrel, and wherein said kit further comprises means for supporting said strap on the end of the barrel of said firearm when said strap is secured to said firearm.

40. A firearm safety kit as defined in claim 39 wherein said supporting means comprises a barrel insert defining an aperture through which said strap may pass.

41. A firearm safety kit as defined in claim 39 wherein said supporting means comprises a barrel cap defining an aperture through which said strap may pass.

42. A firearm safety kit as defined in claim 32 wherein said severing means comprises means for cutting said strap.

43. A firearm safety kit for a firearm capable of firing only after a certain member has been moved to a certain position, said kit comprising:

a frangible strap;

means for securing said frangible strap about the firearm and preventing the certain member from moving to the certain position; and grasping means to be loosely coupled to said strap when said strap is secured about the firearm for facilitating fracture of said strap.

44. A firearm safety kit for a firearm having a barrel and capable of firing only after a certain member has moved to a certain position, said kit comprising:

a fracturable strap;

means for positioning said strap on the forward end of the barrel; and means for securing said strap about the forward end of the barrel and the certain member preventing the certain member from moving to the certain position.

45. A method of rendering a firearm, having a bolt and a chamber, incapable of firing comprising the steps of:

positioning an insert between said bolt and said chamber; and securing a frangible strap around a portion of said firearm to maintain said insert between said bolt and said chamber.

46. A method as defined in claim 45 further comprising coupling means to said frangible strap for facilitating breaking said strap when said firearm is to be used.

47. A method as defined in claim 45 wherein said insert comprises means for receiving said strap to more positively maintain said insert in position.

48. A method as defined in claim 45 wherein the firearm further comprises a receiver in which the bolt is slidably carried, said receiver having an outer portion, and wherein said insert is T-shaped having a cross piece and a leg, said method further including extending said leg into said receiver between said bolt and said chamber, and engaging said cross piece with said outer portion of said receiver.

49. A method of rendering a firearm incapable of firing, said firearm including a member which must be moved to a position before said firearm can be fired, said method comprising securing a frangible strap about said firearm and preventing said member from moving to said position, whereby said secured strap may subsequently be severed and removed from said firearm allowing said firearm to be fired.

50. A method as defined in claim 49 wherein said strap comprises a tail and a locking means for lockingly receiving said tail; and wherein said method further comprises securing said tail within said locking means.

51. A method as defined in claim 49 further comprising coupling means to said strap for facilitating breaking said strap.

52. A method as defined in claim 49 wherein said firearm further includes a hammer, and wherein said method includes securing said strap about said hammer of said gun and a portion of said firearm opposite said hammer.

53. A method as defined in claim 52 wherein said firearm further includes a trigger guard, and wherein said opposite portion comprises said trigger guard of said firearm.

54. A method as defined in claim 49 wherein said firearm further includes a barrel, and wherein said method further comprises:

installing a strap-locating member on the end of said barrel of said firearm, said member defining an aperture; and passing said strap through said aperture.

* * * * *